US010280763B2

(12) United States Patent
Torkaman et al.

(10) Patent No.: US 10,280,763 B2
(45) Date of Patent: May 7, 2019

(54) AIRFOIL COOLING PASSAGEWAYS FOR GENERATING IMPROVED PROTECTIVE FILM

(71) Applicant: Ansaldo Energia Switzerland AG, Baden (CH)

(72) Inventors: Alex Torkaman, Port S. Lucie, FL (US); Gregory Vogel, Palm Beach Gardens, FL (US); Christopher Johnston, Jupiter, FL (US); Michele Borja, Palm Beach Gardens, FL (US)

(73) Assignee: Ansaldo Energia Switzerland AG (CH)

( * ) Notice: Subject to any disclaimer, the term of this patent is extended or adjusted under 35 U.S.C. 154(b) by 408 days.

(21) Appl. No.: 15/177,074

(22) Filed: Jun. 8, 2016

(65) Prior Publication Data

US 2017/0356294 A1 Dec. 14, 2017

(51) Int. Cl.

| | |
|---|---|
| ***F01D 5/18*** | (2006.01) |
| ***F01D 9/04*** | (2006.01) |
| ***F01D 25/12*** | (2006.01) |

(52) U.S. Cl.

CPC ..... *F01D 5/186* (2013.01); *F01D 9/041* (2013.01); *F01D 25/12* (2013.01); *F05D 2220/32* (2013.01); *F05D 2230/12* (2013.01); *F05D 2240/11* (2013.01); *F05D 2240/30* (2013.01)

(58) Field of Classification Search

CPC ..... F01D 5/186

See application file for complete search history.

(56) References Cited

U.S. PATENT DOCUMENTS

| | | | | | |
|---|---|---|---|---|---|
| 4,738,588 | A * | 4/1988 | Field | F01D 5/186 | 415/115 |
| 5,062,768 | A * | 11/1991 | Marriage | F01D 5/186 | 29/889.721 |
| 5,941,686 | A * | 8/1999 | Gupta | F01D 5/186 | 415/115 |
| 6,241,468 | B1 * | 6/2001 | Lock | F01D 5/186 | 415/115 |
| 6,339,879 | B1 * | 1/2002 | Wheat | B21D 53/78 | 29/889.7 |
| 6,897,401 | B2 * | 5/2005 | Kildea | B23H 9/10 | 219/69.15 |
| 7,351,036 | B2 * | 4/2008 | Liang | F01D 5/186 | 416/97 R |

(Continued)

*Primary Examiner* — Woody A Lee, Jr.

(74) *Attorney, Agent, or Firm* — Hovey Williams LLP

(57) ABSTRACT

An airfoil for a gas turbine engine, the airfoil comprising a wall having a first surface, a second surface, and a passageway extending through the wall from a first opening in the first surface to a second opening in the second surface, the passageway having one or more sections between the first opening and the second opening, the one or more sections in fluid communication with each other, the plurality of sections comprising a first diffuser section providing a first change in cross-sectional area within the passageway, a second diffuser section providing a second change in cross-sectional area within the passageway, a flow conditioning section, and an edge section having two surfaces set opposite each other across the passageway, the two surfaces extending along the passageway substantially in parallel to one another, the edge section being located adjacent to the second opening.

18 Claims, 8 Drawing Sheets

(56) References Cited

U.S. PATENT DOCUMENTS

| | | | | |
|---|---|---|---|---|
| 7,377,747 | B2 * | 5/2008 | Lee | F01D 5/188<br>416/96 R |
| 7,883,320 | B2 * | 2/2011 | Pietraszkiewicz | B23H 9/10<br>416/97 R |
| 8,572,983 | B2 * | 11/2013 | Xu | F01D 5/186<br>60/752 |
| 8,591,191 | B1 * | 11/2013 | Liang | F01D 5/186<br>29/889.7 |
| 9,051,842 | B2 * | 6/2015 | Smith | F01D 5/187 |
| 9,068,472 | B2 * | 6/2015 | Rawlinson | F01D 11/122 |
| 9,759,069 | B2 * | 9/2017 | Nita | F01D 5/186 |
| 2013/0259645 | A1 * | 10/2013 | Bergholz, Jr. | F01D 5/18<br>415/115 |
| 2013/0302178 | A1 * | 11/2013 | Bergholz, Jr. | F01D 5/187<br>416/97 R |
| 2014/0003960 | A1 * | 1/2014 | Simpson | F01D 5/186<br>416/97 R |
| 2014/0161585 | A1 * | 6/2014 | Arness | F01D 5/186<br>415/1 |
| 2014/0302278 | A1 * | 10/2014 | Bunker | B05D 3/002<br>428/137 |

* cited by examiner

AIRFOIL COOLING PASSAGEWAYS FOR GENERATING IMPROVED PROTECTIVE FILM

FIELD

The present invention relates to improved cooling passageways formed in airfoils of a gas turbine engine and a method of manufacturing the improved cooling passageways.

BACKGROUND

In a typical operation of a gas turbine engine, the combustor generates high temperature combustion gases that pass through a turbine having a plurality of airfoils. In order to protect these airfoils from the extreme temperatures of the combustion gases, a variety of cooling techniques have been developed. For instance, a plurality of cooling holes may be formed in an outer surface of the turbine airfoil. These cooling holes are adapted to communicate a cooling fluid (e.g., air or steam) from an inner reservoir within the turbine airfoil to the exterior surface of the turbine airfoil. The high velocity of the high temperature combustion gases causes the emitted cooling fluid to wrap over the outer surface of the turbine airfoil and create a thin, protective film layer of cooling fluid between the airfoil outer surface and the high temperature combustion gases. Surface coverage and uniformity of this protective film is essential in improving long term durability and structural integrity of the turbine airfoil.

Referring to FIG. 5A, the second, exterior surface 24A of a prior art airfoil having a plurality of cooling holes 30A is depicted. In order to achieve a consistent protective film layer across the airfoil and maintain the structural integrity of the airfoil, adjacent cooling holes 30A are spaced apart by a spacing wall 58A. The openings of the cooling holes 30A, on the second, exterior surface 24A of the airfoil, are separated by a distance 60A. The distance 60A has been a function of tolerances required to maintain the spacing wall 58A as a unitary member between adjacent cooling holes 30A for the entire distance between the first, interior surface (not shown) and the second, exterior surface 24A. In other words, the distance 60A has been a function of the tolerances required to prevent adjacent cooling holes 30A from intersecting within, or at the surfaces, of the airfoil wall when they were formed. Prior art cooling holes 30A typically included a diffusing section adjacent to the second, exterior surface 24A. Therefore, the distance 60A was dependent on variations of casting surface profile, electrode plunge depth, electrode profile, and part positional tolerances due to opposing sides of the prior art diffusion section being at an angle relative to each other. The distance 60A of prior art diffusion holes are significantly greater than the present invention to account for these previously uncontrollable dependencies. In addition, the diffusing sections of the prior art cooling holes 30A would emit cooling fluid from within the turbine airfoil in a direction where a portion of the emitted cooling fluid from one cooling hole 30A would intersect with a portion of the emitted cooling fluid from an adjacent cooling hole 30A. The intersection of these portions of emitted cooling fluids would cause increased turbulence in the emitted cooling fluid, which is undesirable for forming a uniform protective layer of film between the hot combustion gases and the second, exterior surface 24A. Further, having a diffusing section of the cooling hole 30A at the exterior edge of the cooling hole 30A required an increased distance 60A and consideration of all applicable tolerances in order to avoid one cooling hole 30A intersecting another cooling hole 30A within the wall of the airfoil, or more particularly, at the second, exterior surface 24A of the airfoil.

SUMMARY OF THE INVENTION

A high-level overview of various aspects of the invention is provided here for that reason, to provide an overview of the disclosure and to introduce a selection of concepts that are further described below in the detailed description section below. This summary is not intended to identify key features or essential features of the claimed subject matter, nor is it intended to be used as an aid in isolation to determine the scope of the claimed subject matter.

One aspect of the present invention is directed to an airfoil for a gas turbine engine. The airfoil includes a wall having a first surface and a second surface and a passageway extending through the wall, in a longitudinal direction, from a first opening in the first surface to a second opening in the second surface. The passageway includes a plurality of sections between the first opening and the second opening. The plurality of sections are in fluid communication with each other and adapted to communicate a cooling fluid from within the airfoil out through the second opening where it may form the layer of protective film. The plurality of sections includes a first diffuser section providing a first change in cross-sectional area within the passageway, and second diffuser section providing a second change in cross-sectional area within the passageway, a flow conditioning section located between the first diffuser section and the second diffuser section and having a constant cross-sectional area across its length within the passageway, and an edge section located adjacent to the second opening having two edge surfaces set opposite each other across the passageway and extending along the passageway substantially in parallel alignment to one another. In some aspects, the plurality of sections further includes a flow controlling section beginning at the first opening and extending within the passageway to the first diffuser section. A longitudinal axis represents, in general, the longitudinal direction of passageway extension. In some embodiments, the passageway is formed through the wall in the longitudinal direction such that the longitudinal axis extends through the wall at an angle not normal to the outer surface of the wall. In other embodiments, the angle between the second surface of the wall and the longitudinal axis is small enough that the perimeter of the second opening includes a portion of the second diffuser section and the edge section. In embodiments where the passageway is formed at severe angles, a portion of the edge section forms a channel in the wall of the airfoil.

Another aspect of the present invention is directed to a method of manufacturing an airfoil for a gas turbine engine having improved cooling passageways. The method includes the step of providing an airfoil having a wall extending from a first surface to a second surface. The method further includes the step of forming one or more passageways through the wall. The one or more passageways extend from a respective first opening in the first surface to a respective second opening in the second surface. Each of the one or more passageways includes a plurality of sections between the respective first openings and the respective second openings. The plurality of sections comprise a first diffuser section providing a first change in cross-sectional area within the respective passageway, a second diffuser section providing a second change in cross-sectional area within the respective passageway, a flow conditioning section located between the first and second diffuser sections, the flow conditioning section having a constant cross-sectional area across its length, and an edge section positioned adjacent to the second opening and having two surfaces opposite each other across the passageway, the two surfaces extending along the passageway substantially in parallel to one another. In some aspects the method further includes the step of providing an electrode having one or more shaped electrode teeth. The one or more shaped electrode teeth each has a plurality of tooth sections. The plurality of tooth sections includes a tip section, a constant area section, a first expansion section, and a constant width section. In this respect, the step of forming at least one passageway through the wall is performed by plunging the electrode through the wall (e.g., using an EDM plunge process). In other embodiments of the present invention, the tip section may include a leading tip section, a second constant area section, and a second expansion section. In some embodiments where there are at least three shaped electrode teeth, the at least three shaped electrode teeth are aligned in a row on the electrode.

In yet another aspect of the present invention, an improved cooling hole formed in the wall of a turbine airfoil of a gas turbine engine is provided. The improved cooling hole includes a first opening formed on an inner surface of a turbine airfoil wall and adapted to communicate a cooling fluid from within the airfoil, through a plurality of cavities, and out of a second opening formed on an outer surface of the airfoil wall. The plurality of cavities includes a flow controlling cavity, a first diffusing cavity, a flow conditioning cavity, a second diffusing cavity, and an edge cavity. The flow controlling cavity is formed between flow controlling surfaces that extend from the first opening to the first diffusing cavity. The flow controlling cavity may have a constant cross-sectional area across its length. The first diffusing cavity is formed between first diffusing surfaces that extend from the flow controlling cavity to the flow conditioning cavity. The first diffusing cavity has a first end located proximate to a flow controlling cavity and a second end located proximate to the flow conditioning cavity. The first end of the first diffusing cavity has a first cross-sectional area and the second end of the first diffusing cavity has a second cross-sectional area. The first cross-sectional area is smaller than the second cross-sectional area. The flow conditioning cavity extends from the first diffusing cavity to the second diffusing cavity. The flow conditioning cavity may have a constant cross-sectional area across its length and decreases the turbulence in the cooling fluid that flows through such cavity. The second diffusing cavity extends from the flow conditioning cavity to an edge cavity. The second diffusing cavity has a first end and a second end. In one embodiment, the first end has a cross-sectional area equal to the second cross-sectional area and the second end has a third cross-sectional area. The second cross-sectional area is smaller than the third cross-sectional area. The edge cavity extends from the second diffusing cavity to the second opening in the airfoil wall. The edge cavity has edge surfaces located opposite each other across the edge cavity. The opposing surfaces extend along the edge cavity in parallel to one another from the second diffusing cavity to the second opening and increase coverage and uniformity of the cooling fluid's protective film while allowing positioning of cooling passageways closer to each other with reduced tolerance stack associated with the minimum distance between one cooling passageway to the adjacent one.

BRIEF DESCRIPTION OF THE DRAWINGS

Examples of the present invention are described in detail below with reference to the attached drawing figures, wherein.

DETAILED DESCRIPTION

The subject matter of the present invention is described with specificity herein to meet statutory requirements. However, the description itself is not intended to limit the scope of this patent. Rather, the inventors have contemplated that the claimed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Figure 1:
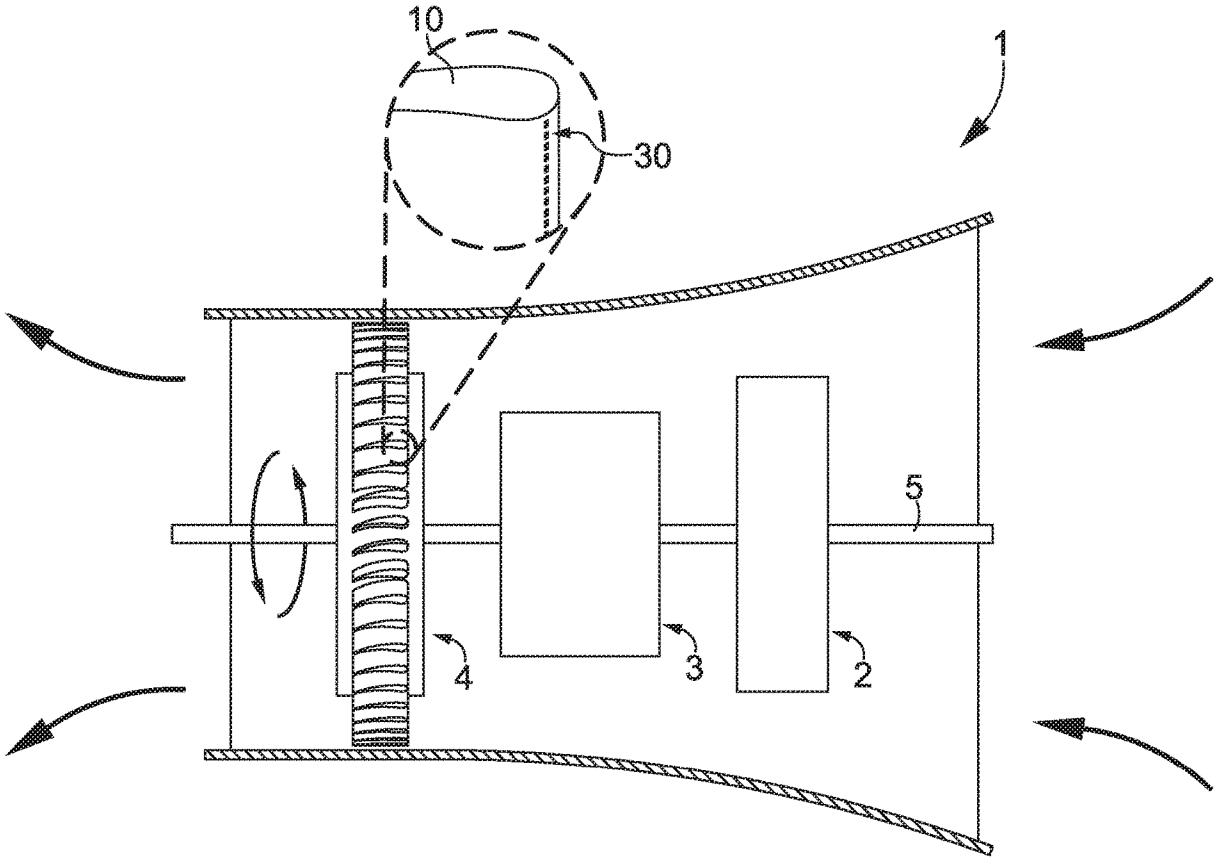
FIG. 1 illustrates an isometric schematic view of an exemplary gas turbine engine in accordance with an aspect described herein.

Referring initially to FIG. 1, a simplified gas turbine engine 1 is depicted. The gas turbine engine 1 includes a compressor 2, a combustor 3, and a turbine 4. In some embodiments, the compressor 2 compresses and drives air through the gas turbine engine 1. The combustor 3 ignites fuel and heats the air to form high temperature combustion gases. Energy from the high temperature combustion gases is converted by the turbine 4 into work to drive a shaft 5. The turbine 4 includes a plurality of airfoils 10. Each of these airfoils 10 includes one or more passageways 30 for communicating a cooling fluid from within the airfoils out of one or more passageways 30 to form a layer of protective film along the surface of the airfoils.

Figure 2:
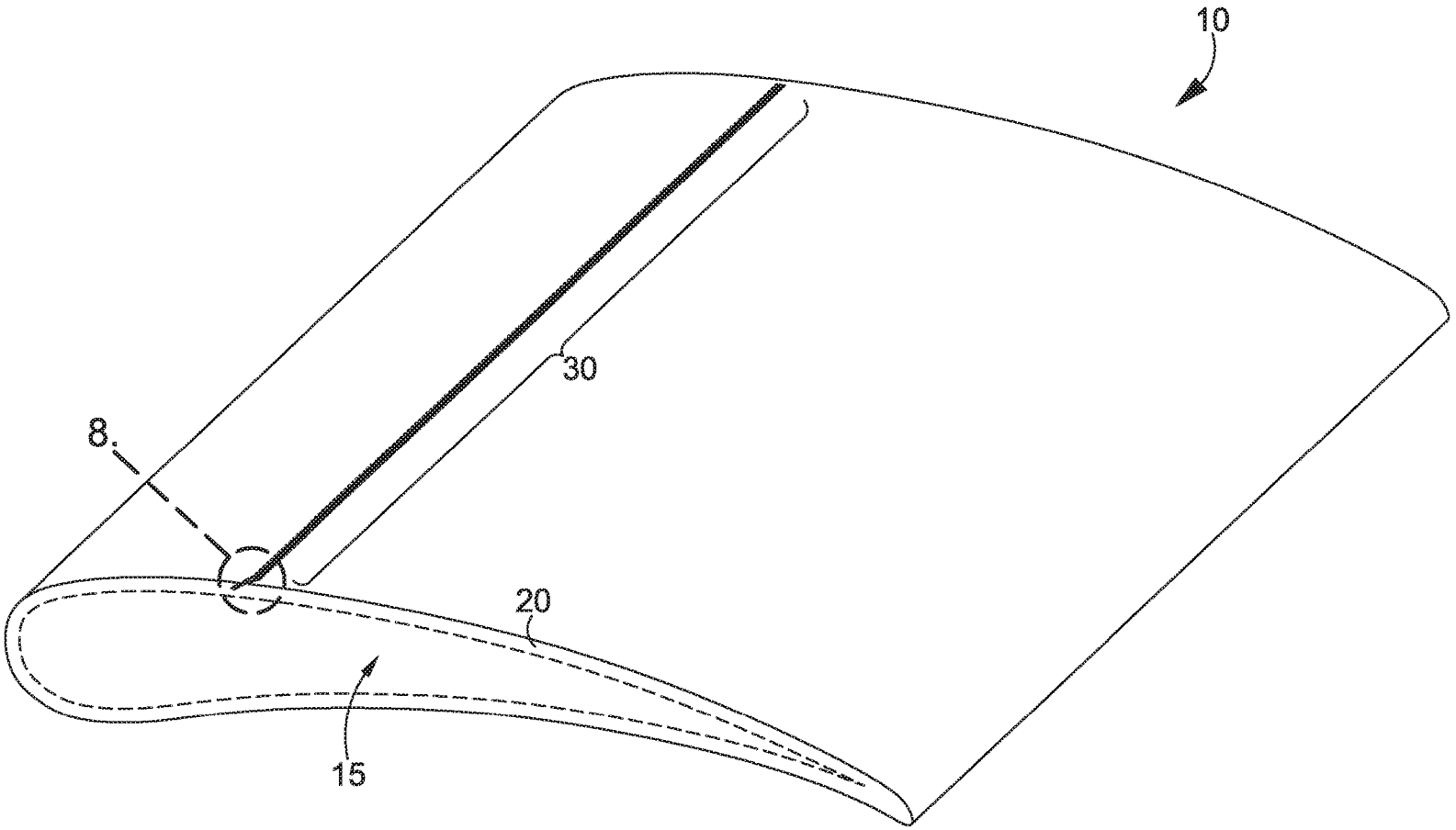
FIG. 2 illustrates a detail view of a turbine airfoil having cooling passageways in accordance with an aspect described herein.

Turning now to FIG. 2, an airfoil 10 is depicted. The airfoil 10 includes a wall 20 that encloses an interior space 15. In some aspects, the interior space 15 may be a large void or chamber. In other aspects, the interior space 15 may be an interior passageway. In yet other aspects, the interior space 15 may include other internal components or compartments. In one embodiment, the interior space 15 may itself comprise a reservoir of cooling fluid. In another embodiment, the interior space 15 is in fluid communication with a reservoir of cooling fluid.

Figure 3:
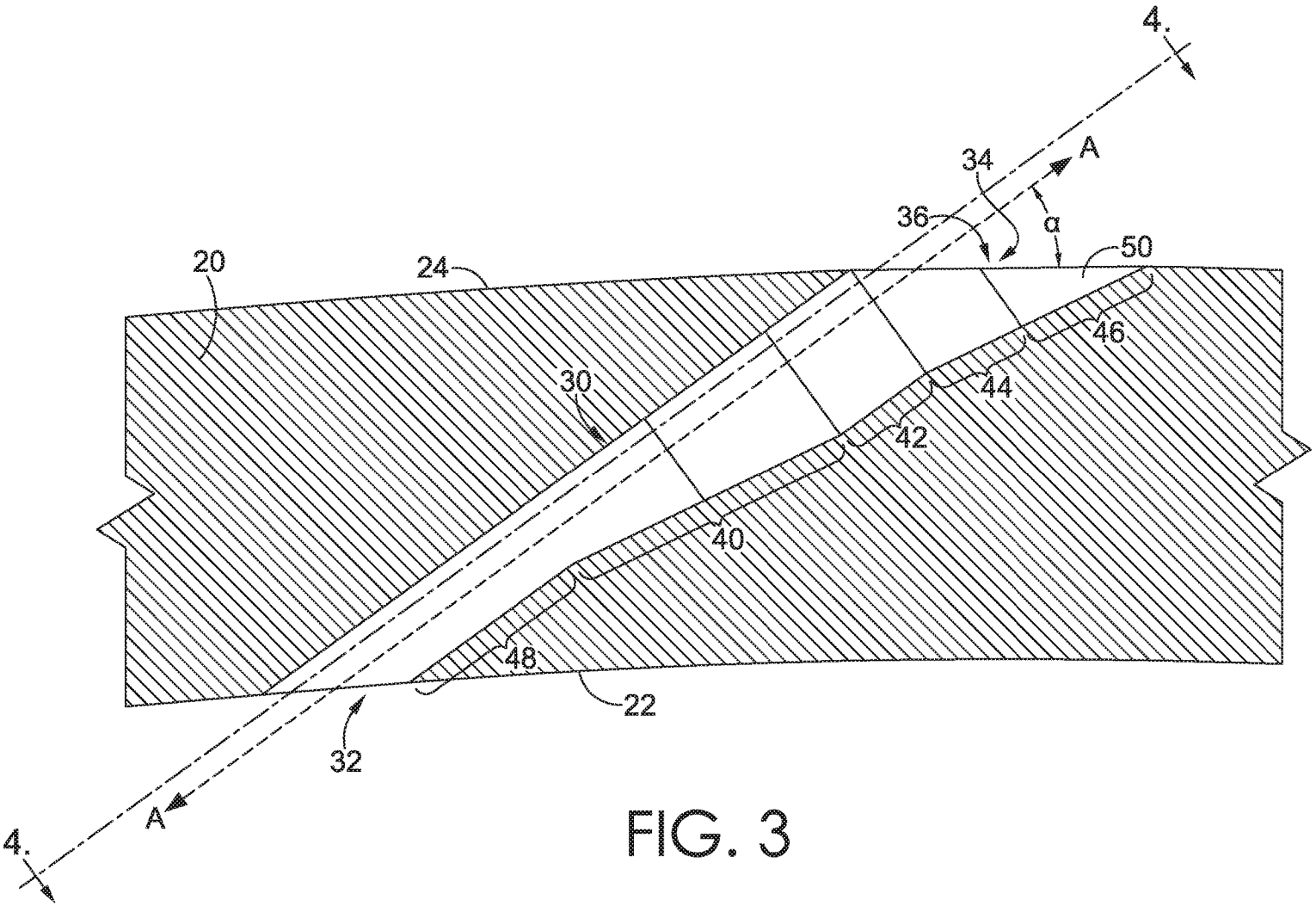
FIG. 3 depicts a cross-section taken along 3-3 of FIG. 4 and illustrates a cooling passageway extending through a wall of a turbine airfoil in accordance with an aspect described herein.

Referring to FIG. 3, the wall 20 includes a first surface 22 and a second surface 24. Each of the one or more passageways 30 extends through the wall 20 from a first opening 32 in the first surface 22, to a second opening 34 in the second surface 24. FIG. 3 depicts a cross-section of an exemplary passageway 30*a* that is one of the one or more passageways 30. It is understood that this description of the exemplary passageway 30*a* applies equally to each of the one or more passageways 30.

The exemplary passageway 30*a* is formed in, and extends through, the wall 20 in a longitudinal direction. A longitudinal axis A is shown extending through the exemplary passageway 30*a* in the longitudinal direction. The longitudinal axis A intersects the plane of the second surface 24 at an angle $\alpha$. In some embodiments, the angle $\alpha$ may be normal to the plane of the second surface 24. In the illustrated embodiment, the angle $\alpha$ is not normal to the plane of the second surface 24. The exemplary passageway 30*a* extends generally straight in the longitudinal direction.

The exemplary passageway 30*a* may include a plurality of sections. The plurality of sections are formed between the first opening 32 and the second opening 34. The plurality of sections are characterized by different cross-sectional areas along the length of each section in the longitudinal direction. In general, the plurality of sections includes at least a first diffuser section 40 providing a first change in cross-sectional area, a second diffuser section 44 providing a second change in cross-sectional area, a flow conditioning section 42 positioned between the first diffuser section 40 and the second diffuser section 44 and having a constant cross-sectional area across its length that reduces the turbulence (relative to prior art) in the cooling fluid passing therethrough, and an edge section 46 having two edge surfaces. The two edge surfaces include a first edge surface 50 and a second edge surface 52 and are positioned across the exemplary passageway 30*a* from one another. In some embodiments, the first edge surface 50 and the second edge surface 52 extend in parallel alignment with the longitudinal axis A. The edge section 46 is located adjacent to the second opening 34 and is adapted for reducing turbulence in the cooling fluid as it is emitted from the exemplary passageway 30*a*, for allowing tighter tolerances when forming the exemplary passageway 30*a*, and for increasing coverage and uniformity associated with a portion of the cooling fluid protective film emitted from the second opening 34. The edge section 46 creates velocity boundary condition on the edges of the emitted flow which prevents intersection of the cooling flow from adjacent cooling passageways and is overall favorable in increasing circumferentially averaged film effectiveness of the cooling fluid, or at least a portion thereof, as it flows between the first edge surface 50 and the second edge surface 52.

Figure 5A:
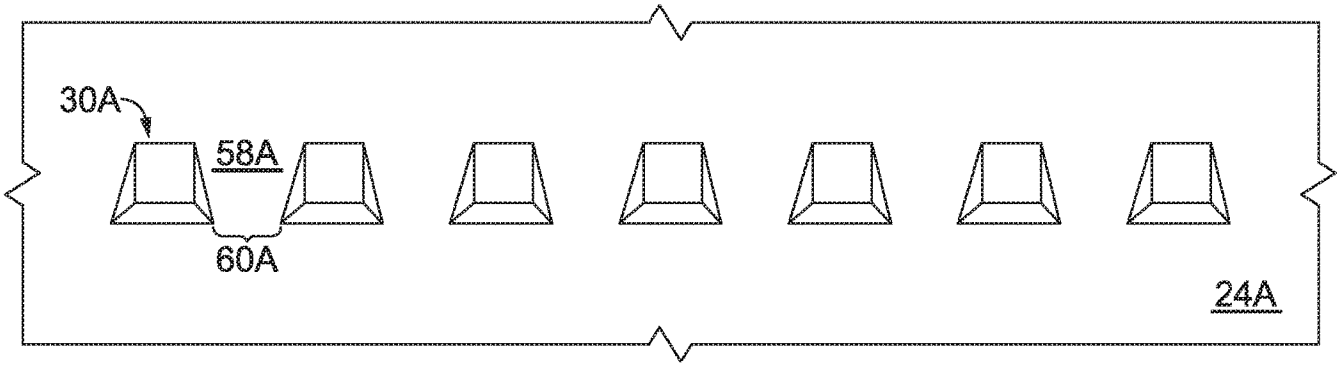
FIG. 5A PRIOR ART
FIG. 5A illustrates a detail view of a prior art turbine airfoil having a plurality of cooling passageways formed through a wall.

The edge section 46 also allows tighter tolerances to be used when manufacturing the airfoil 10 because the first edge surface 50 and second edge surface 52 extend in parallel to one another. Hence, when the one or more passageways 30 are formed in the wall 20, variations in casting surface profile and plunge depth will not cause two adjacent passageways to intersect within, or at the surface of, the wall. This is an improvement over the prior art cooling holes 30A (shown in FIG. 5A) that have a diffuser section formed at the second surface 24A where an inexact plunge could cause a portion of the adjacent passageways to intersect at their diffuser sections.

The edge section 46 also increases film coverage and uniformity associated with the flow of the cooling fluid when it is emitted between the first edge surface 50 and the second edge surface 52 of the exemplary passageway 30*a*, where an adjacent passageway 30*b* (shown in FIG. 5B) has its first edge surface 50 and second edge surface 52 extend in parallel to those of the exemplary passageway 30*a*. The parallel edge surfaces of the exemplary passageway 30*a* and the adjacent passageway 30*b* steer the cooling fluid out from their second openings 34 in the longitudinal direction, generally with a restricted lateral vector. In one embodiment, the adjacent streams of emitted cooling fluid are steered so as not to intersect with one another. In other words, in one embodiment, the adjacent streams of emitted cooling fluid have no lateral vector imparted by the edge sections 46. In another embodiment, a portion of the adjacent streams of emitted cooling fluid are steered so as not to intersect with one another. This reduction or elimination of intersecting adjacent streams of emitted cooling fluid reduces the turbulence caused by such intersection and thereby improves the film layer protecting the airfoil 10 from the high temperature combustion gases.

In some embodiments, a flow controlling section 48 is positioned between the first opening 32 and the first diffuser section 40 and is adapted for metering the flow of cooling fluid through the exemplary passageway 30*a*. The flow controlling section 48 may have a constant cross-sectional area across its length. In some embodiments, the cross-sectional area of the flow conditioning section 42 is 1.8 to 3.6 times larger than the cross-sectional area of the flow controlling section 48.

In some aspects of the present invention, a plurality of other sections may be formed between the above described sections. In other aspects, no other sections are formed between the above described sections.

Figure 4:
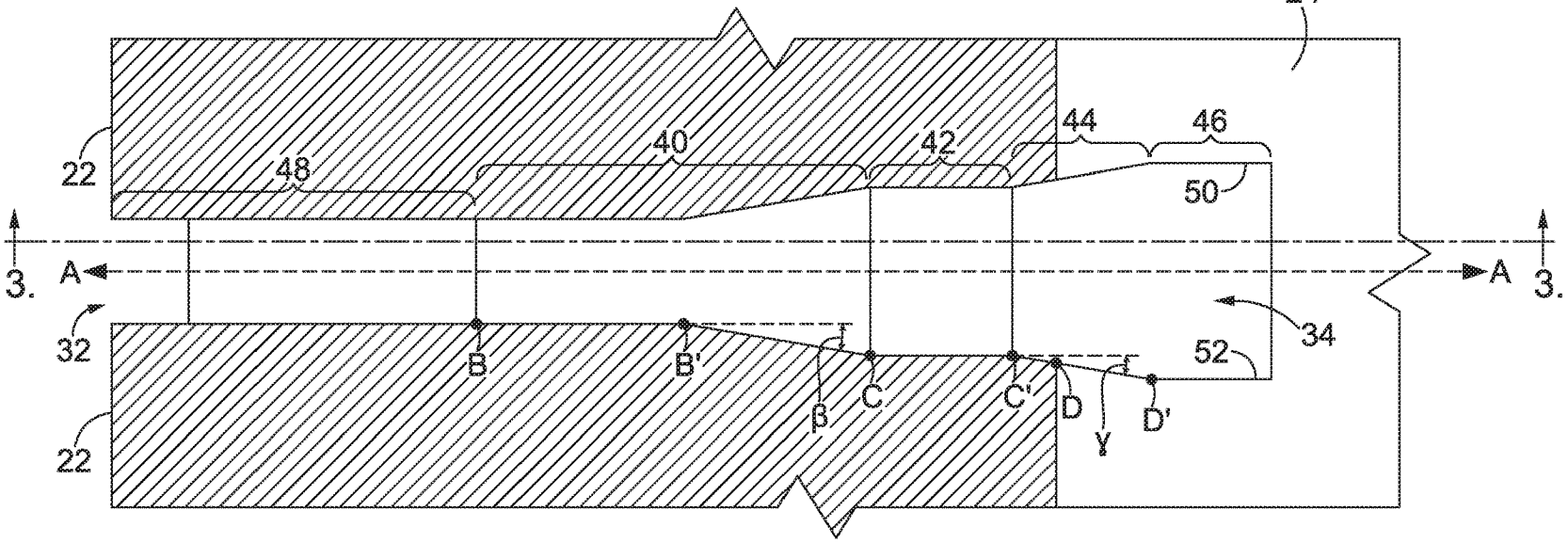
FIG. 4 depicts a cross-section taken along 4-4 of FIG. 3 and illustrates a cooling passageway extending through a wall of a turbine airfoil in accordance with an aspect described herein.

Referring to FIG. 4, a cross-sectional view taken across cut line 4-4 in FIG. 3 is shown depicting the exemplary passageway 30*a* extending through the wall 20. In the depicted embodiment, the exemplary passageway 30*a* extends through the wall 20 at the angle $\alpha$ (shown in FIG. 3) relative to the second surface 24. As such, the cross-section depicted in FIG. 4 is also taken at the angle $\alpha$ and shows a portion of the second surface 24.

The cross-sectional area of the first diffuser section 40 and the second diffuser section 44 may increase in a number of manners. In one aspect, the cross-sectional area may increase by the height dimension increasing along the length of the diffusing section, as is illustrated between reference point B and reference point B' along a portion of the first diffuser section 40 (best seen in FIGS. 3 and 4). In another aspect, the cross-sectional area may increase by the width dimension increasing along the length of the diffusing section, as illustrated between reference point C' and reference point D' along a portion of the second diffuser section 44. In yet another aspect, the cross-sectional area may increase by both its width dimension and its height dimension increasing along the length of the diffusing section, as illustrated between reference point B' and reference point C along a portion of the first diffuser section 40. In other aspects, the diffusing sections may be configured in geometries other than rectangular, such as circular or irregular shapes.

In some aspects, a surface angle β of the first diffuser section 40 may be between 5° and 15°. In other aspects, a surface angle γ of the second diffuser section 44 may be between 5° and 15°. In one aspect, the surface angle β and the surface angle γ are equal.

The illustrated first diffuser section 40 has a first cross-sectional area at reference point B and has a second cross-sectional area at reference point C. The first cross-sectional area is smaller than the second cross-sectional area. The cross-sectional area of the second diffuser section 44 at its smaller end (marked by reference point C') may be the same as the second cross-sectional area at reference point C, as illustrated in FIG. 4. The cross-sectional area of the illustrated second diffuser section 44 increases from the second cross-sectional area to a third cross-sectional area. The third cross-sectional area may be the cross-sectional area of the second diffuser at its larger end (not shown), or the cross-sectional area of the second diffuser at the point where the passageway 30 transitions from a tunnel to a channel 36 (e.g., at reference point D in FIG. 4 and also shown in FIG. 3), or the third cross-sectional area may be the effective cross-sectional area at reference point D'.

An effective cross-sectional area may be determined for the portion of the exemplary passageway 30*a* that comprises the channel 36 by taking a cross-sectional area normal to the longitudinal axis A and providing an effective segment to close the channel 36 (best seen in FIG. 3). Hence, in an embodiment where the portion of the exemplary passageway 30*a* that comprises a channel 36 (i.e., between reference point D and reference point D' in the illustrated embodiment), a cross-section taken that is normal to the longitudinal axis A (in FIG. 3) will have a segment of its perimeter missing. The effective segment is a segment that is added to close the perimeter and lies within the plane defined by the second surface 24.

Figure 5B:
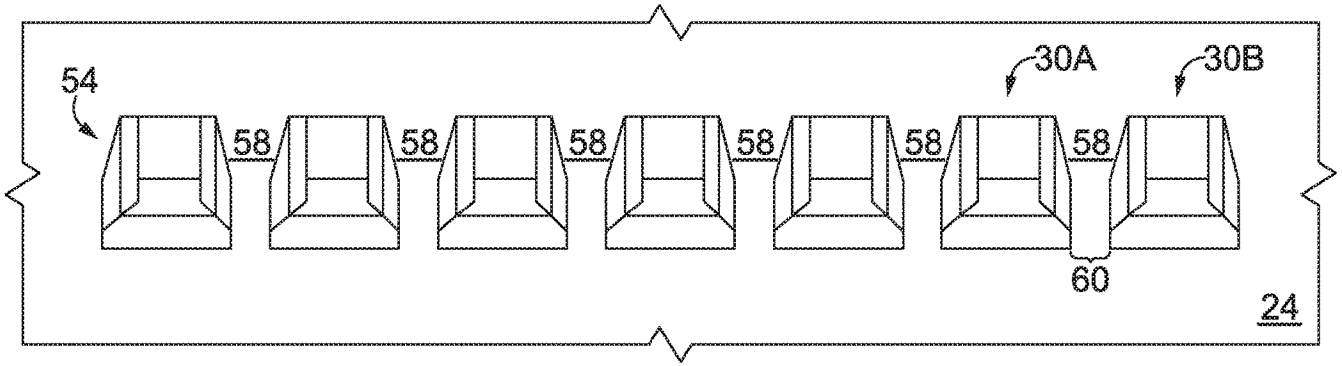
FIG. 5B illustrates a detail view of a turbine airfoil having a plurality of cooling passageways formed through a wall in accordance with an aspect described herein.

Referring to FIG. 5B, one embodiment of the present invention is depicted having the one or more passageways 30 aligned in a row in the wall 20. Between each of the one or more passageways 30 is a spacing wall 58. Each spacing wall 58 extends from the first surface 22 (seen in FIG. 3) to the second surface 24 and prevents fluid communication between the one or more passageways 30 within the wall 20. For example, the spacing wall 58 extends from the first surface 22 (shown in FIG. 3) to the second surface 24 between the exemplary passageway 30*a* and the adjacent passageway 30*b*.

The one or more passageways 30 may be configured in a row, as illustrated in FIG. 5B. In the illustrated embodiment, the exemplary passageway 30*a* and the adjacent passageway 30*b* are spaced apart on the second surface 24 a minimum distance 60. The minimum distance 60 may be located between the first edge surface 50 of the exemplary passageway 30*a* and the second edge surface 52 of the adjacent passageway 30*b*. In one embodiment of the present invention, the minimum distance 60 may be as small as 0.015 inches. In another embodiment, the minimum distance 60 is selected from the range of 0.015 inches to 0.035 inches. Having a smaller minimum distance 60 allows the ratio of second opening 34 area to surface area of the spacing wall 58 presented at the second surface 24 to be favorably increased over the prior art (shown in FIG. 5A), which enhances the coverage and effectiveness of the layer of cooling film formed. In one embodiment, the width of the second opening 34 may be 0.082 inches.

Figure 6:
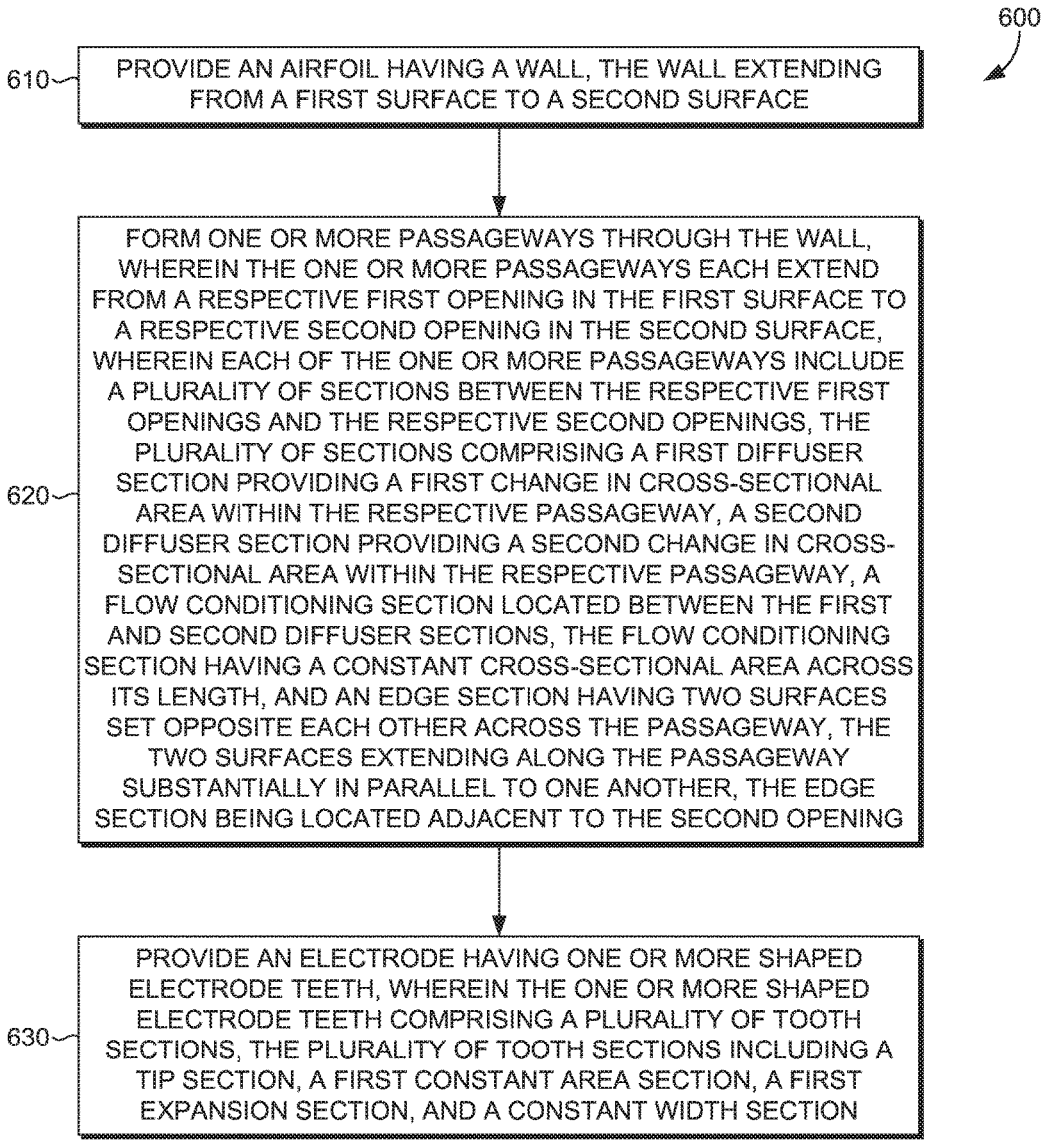
FIG. 6 depicts a flow diagram illustrating an exemplary method of manufacturing an airfoil for a gas turbine engine having improved cooling passageways.

Referring to FIG. 6, another aspect of the present invention is directed to a method 600 of manufacturing an airfoil 10 for a gas turbine engine 1 having improved cooling passageways 30. The method includes the step of providing an airfoil 10 having a wall 20 extending from a first surface 22 to a second surface 24, as depicted in block 610. The method further includes the step of forming one or more passageways 30 through the wall 20, as depicted in block 620. The one or more passageways 30 each extend from a respective first opening 32 in the first surface 22 to a respective second opening 34 in the second surface 24. Each of the one or more passageways 30 includes a plurality of sections between the respective first openings 32 and the respective second openings 34. Each of the plurality of sections comprise a first diffuser section 40 providing a first change in cross-sectional area within the respective passageway 30, a second diffuser section 44 providing a second change in cross-sectional area within the respective passageway 30, a flow conditioning section 42 located between the first diffuser section 40 and the second diffuser section 44 and having a substantially constant cross-sectional area across its length, and an edge section 46 positioned adjacent to the second opening 34 and having a first edge surface 50 opposite a second edge surface 52 across the passageway 30 each extending substantially in parallel to a longitudinal direction of the passageway 30.

Figure 7B:
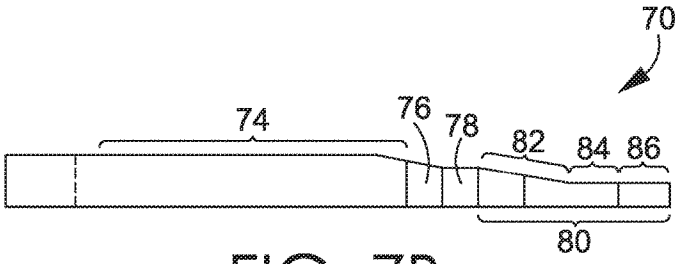
FIG. 7B illustrates a side elevation view of an electrode for forming a plurality of cooling passageways in a turbine airfoil in accordance with an aspect described herein.
Figure 7A:
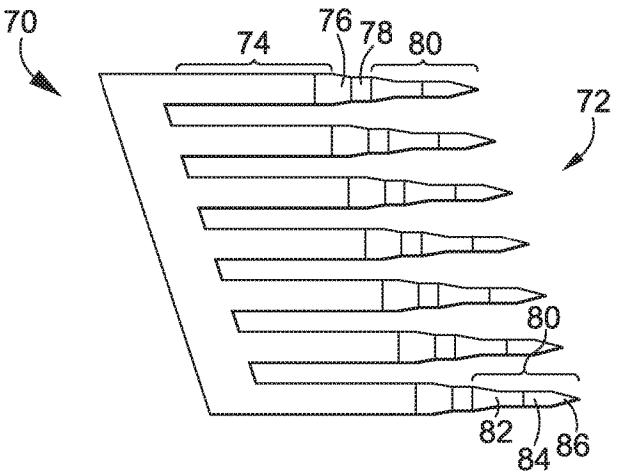
FIG. 7A illustrates a top view of an electrode for forming a plurality of cooling passageways in a turbine airfoil in accordance with an aspect described herein.
Figure 7C:
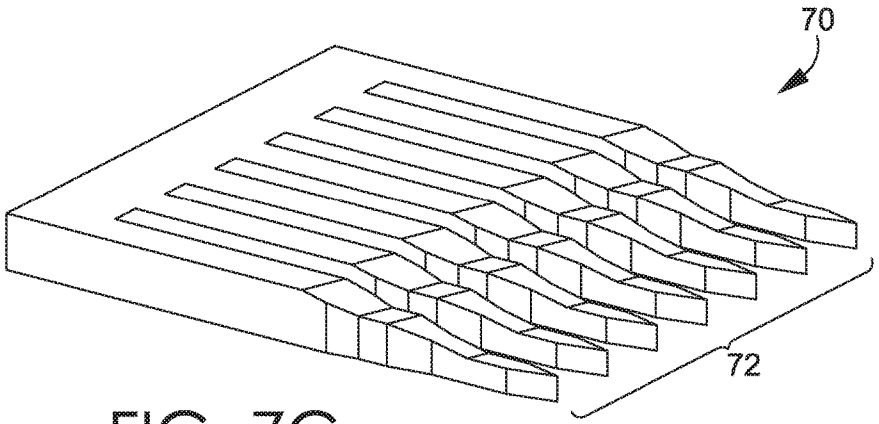
FIG. 7C illustrates an isometric view of an electrode for forming a plurality of cooling passageways in a turbine airfoil in accordance with an aspect described herein.

In some aspects, the method 600 further includes the step of providing an electrode 70 (shown in FIGS. 7A-7C) having one or more shaped electrode teeth 72, as depicted in block 630. Referring to FIGS. 7A-7C, the one or more shaped electrode teeth 72 each include a plurality of tooth sections. The plurality of tooth sections includes a constant width section 74, a first expansion section 76, a constant area section 78, and a tip section 80. The constant width section 74 may be shaped to form the edge section 46. The first expansion section 76 may be shaped to form the second diffuser section 44. The constant area section 78 may be shaped to form the flow conditioning section 42. In one aspect, the tip section 80 may be shaped to form the first diffuser section 40. In another aspect, the tip section 80 may include a second expansion section 82, a second constant area section 84, and a leading tip section 86. The second expansion section 82 may be shaped to form the first diffuser section 40, and the second constant area section 84 may be shaped to form the flow conditioning section 48.

In some aspects, the step of forming one or more passageways 30 through the wall 20, as depicted in block 620, may comprise plunging the one or more shaped electrode teeth 72 through the wall 20 of the airfoil 10 to form the one or more passageways 30. For example, the one or more passageways 30 may be formed through an EDM plunge process.

Figure 8:
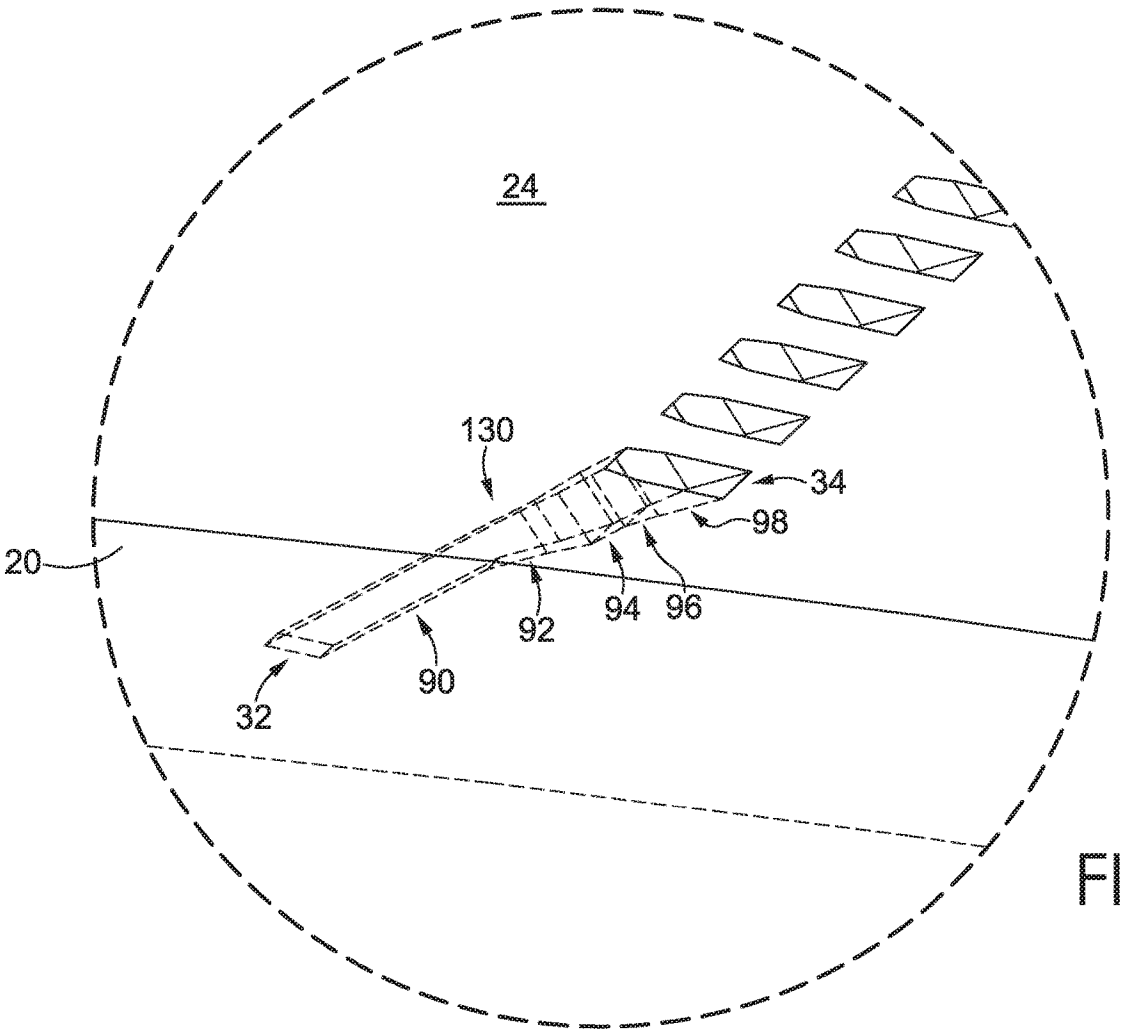
FIG. 8 depicts a detail view taken within 8-8 of FIG. 2 and illustrates an improved cooling hole in accordance with an aspect described herein.

Referring to FIG. 8, another aspect of the present invention is directed to an improved cooling hole 130 formed in the wall 20 of the airfoil 10 (shown in FIG. 2). The improved cooling hole 130 includes the first opening 32 formed on the first surface 22 (shown in FIG. 3) of the wall 20 and is adapted to communicate a cooling fluid from within the airfoil 10, through a plurality of cavities, and out of a second opening 34 formed on an second surface 24 of the wall 20. The plurality of cavities may include a flow controlling cavity 90, a first diffusing cavity 92, a flow conditioning cavity 94, a second diffusing cavity 96, and an edge cavity 98.

The flow controlling cavity 90 may be formed within one or more flow controlling surfaces that extend between the first opening 32 and the first diffusing cavity 92. The flow controlling cavity 90 may have a constant cross-sectional area along the length of the one or more flow controlling surfaces. The flow controlling cavity 90 may be adapted for metering the amount of cooling fluid passing through the improved cooling hole 130.

The first diffusing cavity 92 may be formed within one or more first diffusing surfaces that extend between a first end associated with the flow controlling cavity 90 and a second end associated with the flow conditioning cavity 94. The cross-sectional area of the first diffusing cavity 92 increases between the first end and second end of the one or more first diffusing surfaces. The first diffusing cavity 92 expands the stream of cooling fluid passing through the improved cooling hole 130 to promote formation of a more effective layer of protective film on the second surface 24.

The flow conditioning cavity 94 may be formed within one or more flow conditioning surfaces that extend between a first end associated with the first diffusing cavity 92 and a second end associated with the second diffusing cavity 96. The flow conditioning cavity 94 may have a constant cross-sectional area along the length of the one or more flow conditioning surfaces to promote less turbulent flow of the cooling fluid passing through the improved cooling hole 130.

The second diffusing cavity 96 may be formed within one or more second diffusing surfaces that extend between a first end associated with the flow conditioning cavity 94 and a second end associated with the edge cavity 98. The cross-sectional area of the second diffusing cavity 96 increases between the first end and second end of the one or more second diffusing surfaces. The second diffusing cavity 96 expands the stream of cooling fluid passing through the improved cooling hole 130 to promote formation of a more effective layer of protective film on the second surface 24.

The edge cavity 98 may be formed within one or more edge surfaces that extend between the second diffusing cavity 96 and the second opening 34 and includes at least two opposing surfaces set across the edge cavity 98 from one another and that extend in parallel from the second diffusing cavity 96 to the second opening 34. The edge cavity 98 may have a constant cross-sectional area along the length of the one or more edge surfaces. In another aspect, the edge cavity 98 may have a constant width along the length of the at least two opposing surfaces. The edge cavity 98 may be adapted for emitting the cooling fluid in a manner that increases film coverage and uniformity in the stream of cooling fluid passing through the improved cooling hole 130 and emitting in a direction that results in less turbulence causing interference from an adjacent stream of cooling fluid emitted from an adjacent improved cooling hole 130.

From the foregoing, it will be seen that aspects described herein are well adapted to attain all the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims. Since many possible aspects described herein may be made without departing from the scope thereof, it is to be understood that all matter herein set forth or shown in the accompanying drawings is to be interpreted as illustrative and not in a limiting sense.

The invention claimed is:

1. An airfoil for a gas turbine engine, the airfoil comprising:

a wall having a first surface, a second surface, and a passageway extending through the wall from a first opening in the first surface to a second opening in the second surface, the passageway having a plurality of sections between the first opening and the second opening, the plurality of sections in fluid communication with each other, the plurality of sections comprising:

a first diffuser section providing a first change in cross-sectional area within the passageway;

a second diffuser section providing a second change in cross-sectional area within the passageway;

a flow conditioning section located between the first diffuser section and the second diffuser section, the flow conditioning section having a constant cross-sectional area; and an edge section having two surfaces set opposite each other across the passageway, the two surfaces extending along the passageway substantially in parallel to one another, the edge section being located adjacent to the second opening, wherein surfaces of the flow conditioning section extend in parallel to a central axis extending through the wall in an axial direction of the passageway, and wherein each of the first and the second diffuser sections has a surface angle of 5 to 15 degrees relative to the surfaces of the flow conditioning section.

2. The airfoil of claim 1, wherein the plurality of sections further comprises:

a flow controlling section beginning at the first opening opposite the edge section and extending to the first diffuser section.

3. The airfoil of claim 2, wherein the constant cross-sectional area of the flow conditioning section is 1.8 to 3.6 times larger than a cross-sectional area of the flow controlling section.

4. The airfoil of claim 3, wherein the first diffuser section increases its cross-sectional area from a first cross-sectional area to a second cross-sectional area, and wherein the second diffuser section increases its cross-sectional area from the second cross-sectional area to a third cross-sectional area.

5. The airfoil of claim 2, wherein surfaces of the flow controlling section extend in parallel to the central axis.

6. The airfoil of claim 5, wherein surfaces of each of the plurality of sections that extend through the wall are centered on a longitudinal axis.

7. The airfoil of claim 5, wherein the passageway extends through the wall at an angle such that the central axis is not normal to the first surface or the second surface.

8. The airfoil of claim 7 further comprising:

a perimeter of the second opening including a portion of the edge section and a portion of the second diffuser section.

9. The airfoil of claim 8, wherein the passageway comprises a channel in the wall at the edge section.

10. The airfoil of claim 1, wherein the flow conditioning section has a length to hydraulic diameter ratio of 0.6 to 1.4.

11. The airfoil of claim 1, wherein the wall further comprises a plurality of passageways extending between the first surface and second surface.

12. The airfoil of claim 11, wherein a minimum distance on the second surface between a first passageway of the plurality of passageways and an adjacent second passageway of the plurality of passageways is 0.015 inches to 0.035 inches.

13. The airfoil of claim 12, further comprising a spacing wall extending from the first surface to the second surface, the spacing wall preventing fluid communication between the first passageway and the second passageway.

14. A method of manufacturing an airfoil for a gas turbine engine, the airfoil having at least one passageway through a wall, the method comprising the steps of:

providing an airfoil having a wall, the wall extending from a first surface to a second surface; and forming one or more passageways through the wall, wherein the one or more passageways each extends from a respective first opening in the first surface to a respective second opening in the second surface, wherein each of the one or more passageways includes a plurality of sections between the respective first opening and the respective second opening, the plurality of sections comprising a first diffuser section providing a first change in cross-sectional area within the respective passageway, a second diffuser section providing a second change in cross-sectional area within the respective passageway, a flow conditioning section located between the first and second diffuser sections, the flow conditioning section having a constant cross-sectional area across its length, and an edge section having two surfaces set opposite each other across the passageway, the two surfaces extending along the passageway substantially in parallel to one another, the edge section being located adjacent to the second opening, wherein surfaces of the flow conditioning section extend in parallel to a central axis extending through the wall in an axial direction of the passageway, and wherein each of the first and the second diffuser sections has a surface angle of 5 to 15 degrees relative to the surfaces of the flow conditioning section.

15. The method of claim 14, wherein the step of forming one or more passageways through the wall further comprises:

providing an electrode having one or more shaped electrode teeth;

the one or more shaped electrode teeth comprising a plurality of tooth sections, the plurality of tooth sections each including a constant width section, a first expansion section, a first constant area section, a second expansion section, a second constant area section, and a leading tip section; and forming the at least one passageway by plunging a portion of the electrode through the wall.

16. The method of claim 15, wherein the step of forming one or more passageways through the wall comprises performing an EDM plunge process.

17. The method of claim 15, wherein the one or more shaped electrode teeth are aligned in a row.

18. An improved cooling hole for a turbine of a gas turbine engine comprising:

a first opening formed in an inner surface of a turbine airfoil wall and adapted to communicate a cooling fluid from within the airfoil, through a plurality of cavities, and out of a second opening formed in an outer surface of the airfoil wall;

a flow controlling cavity extending outwardly through a portion of the airfoil wall from the first opening;

a first diffusing cavity extending through a portion of the airfoil wall from the flow controlling cavity to a flow conditioning cavity, the first diffusing cavity having a first end located proximate to the flow controlling cavity, a second end located proximate to the flow conditioning cavity, the first end having a first cross-sectional area and the second end having a second cross-sectional area, the first cross-sectional area is smaller than the second cross-sectional area;

the flow conditioning cavity extending through a portion of the airfoil wall from the first diffusing cavity to a second diffusing cavity, the flow conditioning cavity having a constant cross-sectional area across its length;

the second diffusing cavity extending through a portion of the airfoil wall from the flow conditioning cavity to an edge cavity, the second diffusing cavity having a third end and a fourth end, the third end having the second cross-sectional area and the fourth end having a third cross-sectional area, the second cross-sectional area is smaller than the third cross-sectional area; and the edge cavity extending through a portion of the airfoil wall from the second diffusing cavity to the second opening, the edge cavity having opposite surfaces located across the edge cavity from each other, the opposite surfaces extending along the edge cavity substantially in parallel to one another from the second diffusing cavity to the second opening, wherein surfaces of the flow conditioning cavity extend in parallel to a central axis extending through the airfoil wall in an axial direction of the cooling hole, and wherein each of the first and the second diffusing cavities has a surface angle of 5 to 15 degrees relative to the surfaces of the flow conditioning cavity.

* * * * *